United States Patent [19]

Sutherland

[11] 4,354,515

[45] Oct. 19, 1982

[54] DRAIN PIPE FLUSHING APPARATUS

[76] Inventor: Rabion C. Sutherland, 1210 Willow St., Flint, Mich. 48503

[21] Appl. No.: 205,165

[22] Filed: Nov. 10, 1980

[51] Int. Cl.[3] ..... B08B 3/02; B08B 9/02

[52] U.S. Cl. ..... 134/167 C; 15/104.3 R; 137/883; 138/90

[58] Field of Search ..... 15/104.3 R; 138/90; 134/166 C, 167 C, 168 C, 169 C, 24; 137/883

[56] References Cited

U.S. PATENT DOCUMENTS

| | | | |
|---|---|---|---|
| 1,099,713 | 6/1914 | Morris | 137/883 |
| 1,506,418 | 8/1924 | Evensta et al. | 138/90 |
| 1,510,212 | 9/1924 | DuBois | 15/104.3 R |
| 2,763,288 | 9/1956 | Tharp | 134/168 C X |
| 3,075,535 | 1/1963 | Lasting | 134/167 C |

FOREIGN PATENT DOCUMENTS

| | | | |
|---|---|---|---|
| 2502056 | 7/1975 | Fed. Rep. of Germany | 134/167 C |

*Primary Examiner*—Robert L. Bleutge
*Attorney, Agent, or Firm*—Gerald J. Ferguson, Jr.; Joseph J. Baker; C. Lamont Whitham

[57] ABSTRACT

An apparatus for flushing drain pipes is disclosed having an expansible member of resilient material insertable into the pipe to be flushed, a first valve for connecting the expansible member to a source of fluid under pressure for filling and emptying the expansible member and a second valve also connected to the source of fluid under pressure for flushing the obstruction from the pipe.

6 Claims, 3 Drawing Figures

DRAIN PIPE FLUSHING APPARATUS

BACKGROUND AND OBJECTS OF THE INVENTION

This invention relates to a flushing apparatus and more specifically to a novel and more reliable device for unclogging and cleaning various types of drain pipes.

It is the primary object of this invention to provide a device for removing obstructions from drain pipes having an expansible member which, after its insertion into the drain pipe, may be expanded by a fluid under pressure to provide a fluid tight joint between the expansible member and the inner surface of the pipe to enable fluid under sufficient pressure to be injected between the expansible member and the obstruction to force the obstruction from the pipe.

The prior art structure in this area of which applicant is aware is exemplified, for example, in U.S. Pat. No. 3,075,535 which discloses a device for unclogging drains having an expansible chamber and a single four position valve of complex costly construction. In the first position of the valve, the expansible chamber is filled with water under pressure to expand same against the inner surface of the obstructed pipe. Rotation of the valve to the second position closes off water pressure to the expansible chamber and further rotation of the valve to the third position introduces water under pressure between the obstruction and the expansible chamber for forcing the obstruction from the pipe. The fourth position drains the water from the expansible chamber into the unobstructed pipe. If the obstruction is loosely held in the pipe, such prior art devices work fairly satisfactorily. However, if the obstruction is firmly held, the continued flow of water under pressure in the area between the obstruction and the expansible chamber builds to the point where the expansible chamber is deformed causing the pressurized water to escape around the sides thereof or the expulsion of the expansible chamber from the pipe with the obstruction remaining in place.

The present invention overcomes the aforedescribed disadvantages of the prior art by providing a flushing apparatus which utilizes separate and independent valves, one valve of which controls the flow of fluid under pressure to the expansible chamber, the other valve controls the flow of pressurized fluid to the area between the obstruction and the expansible chamber for removing the obstruction. Thus, in applicant's apparatus, if the obstruction is firmly held, fluid pressure can be increased in the expansible chamber by the valve associated therewith to increase the chamber's frictional hold on the inside wall of the pipe while at the same time fluid under sufficient pressure can be introduced through the other valve to dislodge the obstruction. With applicant's device, no leakage of fluid past or expulsion of the expansible chamber will result as is possible with the prior art devices. In order to ensure that the designed burst limit of applicant's expansible chamber is not exceeded, a pressure regulator may be installed in the fluid supply line leading thereto. In addition, applicant's use of a simple commercially available device housing both valves substantially reduces the overall cost below that associated with the devices of the prior art.

It is therefore a further primary object of the present invention to provide a superior as well as novel apparatus for removing more difficult obstructions from drain pipes than are capable with the devices of the prior art.

It is another object of the present invention to provide an apparatus for the purpose described which is manually controlled and does not require any particular skill or knowledge in its operation.

It is a further object of the present invention to provide a device for the described purpose which is efficient, durable and economical to make, use and maintain.

These and other objects and advantages of the invention will become apparent upon reference to the following specification, attendant claims and drawing.

DETAILED DESCRIPTION OF INVENTION

Figure 1:
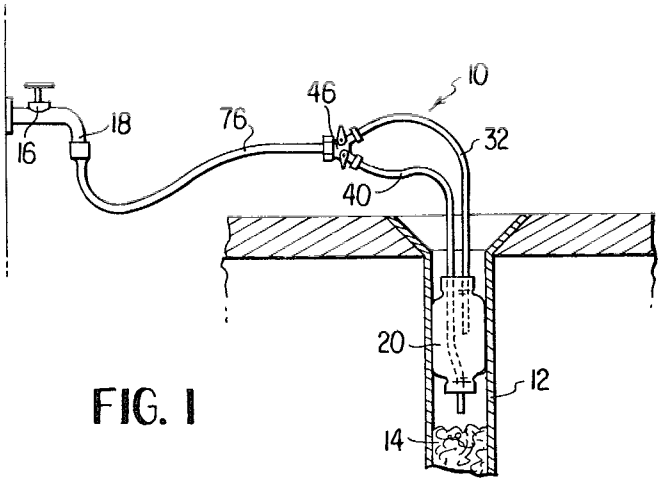
FIG. 1 is a vertical section taken through the center of a drain pipe showing my improved flushing apparatus positioned adjacent an obstruction to be removed and connected to a water faucet.

Referring now to the drawing where like characters of reference indicate like elements in each of the several figures, FIG. 1 depicts a typical use of the flushing apparatus of the present invention. The flushing apparatus 10 as shown in position in a sewer pipe 12 having an obstruction 14, which is desired to be dislodged and flushed away. The flushing apparatus 10 is connected to a standard type of faucet 16 having the usually downwardly turned spout 18 with an externally threaded end for the attachment of a hose coupling of standard make.

Figure 2:
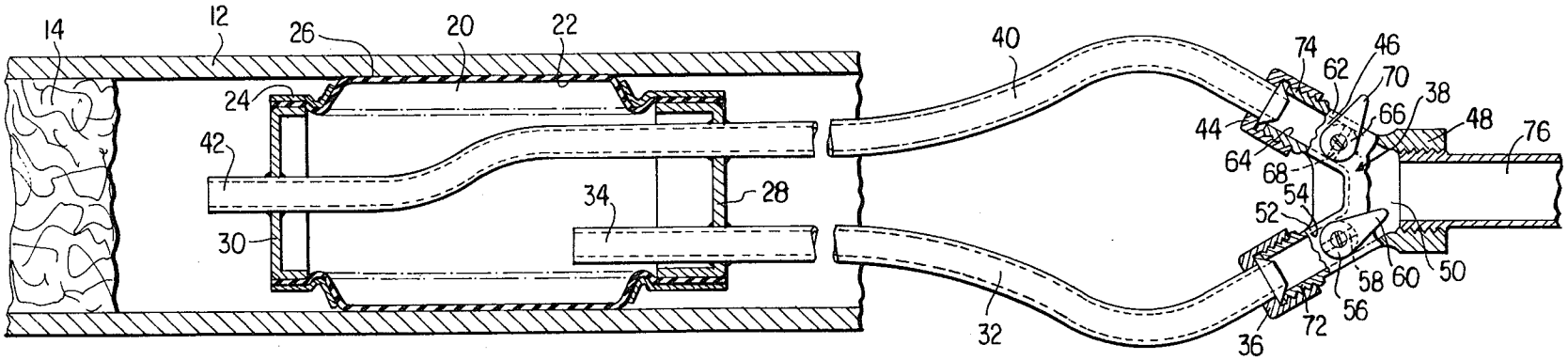
FIG. 2 is an enlarged sectional detail taken through a fragmentary portion of the drain pipe with the flush chamber in its expanded state.

The flushing apparatus 10, as can be more clearly seen by referring to FIG. 2, consists of a chamber or tube 20 formed of rubber or other elastic-type material which is capable of expanding principally in a radial direction in response to the application of a fluid under pressure on the inside walls 22 thereof. A sheet of rubber or other plastic-type reinforcing material 24 can be secured to outer surface 26 of the end walls 28,30 of the chamber 20 to reinforce the ends and limit their expansion during the application of high fluid pressure to prevent bursting of the chamber. A first hose 32 is provided which has an end 34 thereof extending through the end wall 28 and is molded or bonded to the end wall 28 for supplying a fluid, typically water under pressure, to the inside of the chamber 20. The first hose 32 has a standard hose coupling 36 on the other end thereof for connecting the faucet 16 by way of a valve assembly 38 which will be more fully described later.

A second hose 40 is also provided which extends through the end walls 28,30 and terminates at an end 42 outside the chamber 20. The second hose 40 is also bonded in watertight engagement with the chamber 20 and has a standard hose coupling 44 for connection to the valve assembly 38. First and second hoses 32,40 respectively can be made of polybutylene tubing or similar easily bondable, high pressure material.

The valve assembly 38 comprises a substantially Y-shaped housing 46 of durable plastic material having a standard female coupling member 48 on the end of the stem portion 50 thereof. The housing 46 has an arm 52 with a throughbore 54 having mounted therein a first rotatable ball valve element 56 also with a throughbore 58. The ball valve element 56 is manually rotatable by means of a handle 60 such that in its open position the ball valve element 56 is rotated such that the throughbores 54,58 are axially aligned and in its closed position, the throughbore 58 of the ball element 56 is transverse to the axis of the throughbore 54. Similarly, the housing 46 has another arm 62 with a throughbore 64 having a second rotatable ball valve element 66 also with a throughbore 68. The ball valve element 64 has a handle 70 for rotating same to the open and closed position in the same manner as ball valve element 56 previously described. The arms 52,60 have standard male threaded ends 72,74, respectively, for connection to the hose coupling members 36, 44. A standard garden hose 76 or the like can be used to connect the valve assembly 38 at coupling 48 to the spout 18 of the faucet 16. The valve assembly 38 can be readily purchased commercially and is made by the Nelson Corporation of Peoria, Ill.

Figure 3:
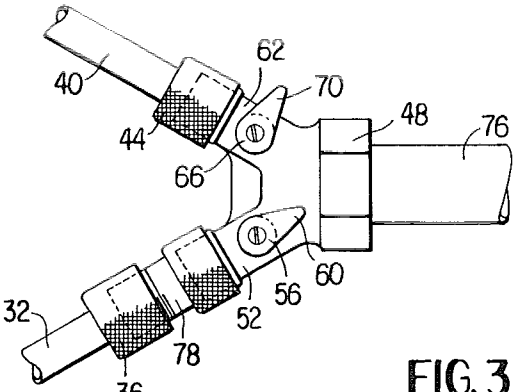
FIG. 3 is an elevational view of the dual valve showing the attachment of a pressure regulator thereto.

Inasmuch as the pressure of the water available at residential or commercial faucets can vary considerably depending on the locale and the capacity of the pumping means supplying same, a water pressure regulator 78 as seen in FIG. 3 can be installed between the arm 52 and the hose 32 supplying the expansible chamber 20. The cut off pressure of the regulator 78 would be chosen below the burst pressure of the walls of the expansible chamber 20 so as to stop the flow of water thereto when the cut off pressure is reached. The pressure regulator 78 is also readily commercially available.

OPERATION

To operate the flushing apparatus 10, the expansible chamber 20 is inserted into the clogged pipe 12 above the obstruction 14 as shown in FIG. 1. The first and second valves 56,66 are rotated to their closed positions and the faucet 16 opened. The first valve 56 is then opened to fill the expansible chamber 20 against the inside wall of the obstructed pipe 12. In the first mode of operation, the valve 56 is shut off when it is assumed the expansible chamber 20 has sufficiently sealed off the opening above the obstruction 14. The second valve 66 is then opened and water is introduced through line 40 between the obstruction 14 and the expansible chamber 20 to thereby break up and force the obstruction 14 down the drain. If, however, it is realized that the obstruction is firmly held and water introduced through hose 40 is escaping around the expansible chamber 20, the second mode of operation can be employed whereby the first valve 56 is reopened to permit additional water under pressure to enter the expansible chamber 20 to increase the frictional engagement thereof with the inside wall of the clogged pipe 12 while at the same time additional water is introduced through second valve 66 to dislodge the obstruction. Thus, the water pressure in the expansible chamber 20 can be increased substantially due to its novel reinforced construction and two valve assembly up to its burst limit or just below it if the pressure regulator is used. Shutting off faucet 16 and opening both valves 56,66 permits water from the expansible chamber 20 to drain out hose end 42.

While a particular embodiment of this invention has been shown and described, it is not intended to limit the same to the exact details of the construction set forth, and it embraces such changes, modifications, and equivalents of the parts and their formation and arrangement as come within the purview of the appended claims.

What I claim is:

1. A drain pipe flushing apparatus comprising:

(a) an expansible member of resilient material insertable in a pipe to be flushed, (b) a first manually controlled valve adapted to be connected at its inlet to a source of fluid under pressure and at its outlet to a first hose having connection to first point of said expansible chamber for filling and emptying same, and (c) a second manually controlled valve adapted to be connected at its inlet to said source of fluid under pressure and at its outlet to a second hose non-centrically disposed with respect to the first hose such that the second hose enters said expansible chamber at a second point removed from said first point and passes through the chamber for flushing said pipe where said first and second hoses extend over different paths to the expansible chamber and where said inlets of said first and second valves are connected to a common coupling member which, in turn, is connected to said source of fluid.

2. A flushing apparatus as set forth in claim 1 wherein said inlets of said first and second valves are connected to common coupling means.

3. A flushing apparatus as set forth in claim 1 further comprising a housing for said first and second manually controlled valves that is Y-shaped, said first manually controlled valve being located in one arm of said Y-shaped housing and said second manually controlled valve being located in another arm of said Y-shaped housing.

4. A flushing apparatus as set forth in claim 3 wherein said housing and said first and second manually controlled valves are made of plastic.

5. A flushing apparatus as set forth in claim 1 wherein said expansible member has a layer of reinforcing material secured to the ends thereof.

6. A flushing apparatus as set forth in claim 1 further comprising a water pressure regulator connected between said outlet of said first manually controlled valve and said first hose to prevent said expansible chamber from bursting from excessive pressure.

* * * * *